US006817396B2

(12) United States Patent
Bathelier

(10) Patent No.: US 6,817,396 B2
(45) Date of Patent: Nov. 16, 2004

(54) APPARATUS FOR MANUFACTURING TEXTILE PRODUCTS

(75) Inventor: Xavier Bathelier, Saint-Pierremont (FR)

(73) Assignee: Tarkett Sommer S.A., Nanterre (FR)

( * ) Notice: Subject to any disclaimer, the term of this patent is extended or adjusted under 35 U.S.C. 154(b) by 179 days.

(21) Appl. No.: 10/163,051

(22) Filed: Jun. 5, 2002

(65) Prior Publication Data

US 2002/0153082 A1 Oct. 24, 2002

Related U.S. Application Data

(62) Division of application No. 09/355,381, filed as application No. PCT/EP98/00770 on Feb. 11, 1998, now Pat. No. 6,432,234.

(30) Foreign Application Priority Data

Feb. 14, 1997 (EP) ..... 97870019

(51) Int. Cl.[7] ..... D04H 11/00; B32B 31/08; B32B 31/12

(52) U.S. Cl. ..... 156/435; 156/437; 156/441; 156/459; 156/578

(58) Field of Search ..... 156/72, 178, 179, 156/254, 269, 435, 437, 441, 459, 578

(56) References Cited

U.S. PATENT DOCUMENTS

| | | | | |
|---|---|---|---|---|
| 3,705,063 | A | 12/1972 | Stumpf | 156/72 |
| 3,755,051 | A | 8/1973 | Stumpf | 161/63 |
| 5,239,734 | A | 8/1993 | Bathelier et al. | 28/107 |
| 5,867,880 | A | 2/1999 | Bathelier et al. | 28/107 |
| 6,012,205 | A | 1/2000 | Bathelier et al. | 28/107 |

*Primary Examiner*—Sam Chuan Yao
(74) *Attorney, Agent, or Firm*—Alix, Yale & Ristas, LLP

(57) ABSTRACT

The present invention relates to a method for producing a textile product of the lapped/bonded type from fibers and/or filaments travelling in the direction of advance in the form of a web, this method comprising at least one step, called the "prelooping step", in which the fibers and/or filaments individually undergo looping transversely to the direction of advance of the web, if appropriate accompanied by transverse drawing, characterized in that it subsequently comprises a step of confining the parallelized fibers and/or filaments in the form of loops, this latter confining step taking place directly on a support, without transport members, such as needles or transfer elements, being involved.

14 Claims, 4 Drawing Sheets

APPARATUS FOR MANUFACTURING TEXTILE PRODUCTS

CROSS REFERENCE TO RELATED APPLICATIONS

This is a divisional application of U.S. patent application Ser. No. 09/355,381, filed Jul. 26, 1999 now U.S. Pat. No. 6,432,234 B1, which was the U.S. national phase of International Application No. PCT/EP98/00770, filed Feb. 11, 1998.

SUBJECT OF THE INVENTION

The present invention relates to an improved method for the manufacture of textile products of the "lapped/bonded" type directly from fibres and/or from filaments.

The invention also relates to an apparatus for carrying out the method and to the products obtained by means of the said method.

PRIOR ART ON WHICH THE INVENTION IS BASED

So-called "lapped/bonded" products are products which are produced from a textile lap, preferably from a lap already consisting of threads, or, if appropriate, from a fibrous lap, which is subjected to a succession of foldings for the purpose of forming folds which may be likened, in the direction of advance of the lap, to loops. This folded lap is subsequently simply fixed to a support by adhesive bonding. A product is thus obtained, in which the threads and/or fibres do not pass through the support, in contrast to tufted products which take the form of a succession of loops passing through the support.

There are, at the present time, essentially two large families of methods intended for producing textile products of the "lapped/bonded" type.

The first family is the best known and comprises the methods employing a machine with arms, to which blades are fastened. A lap of threads is pushed by these blades successively onto a first backboard, then onto a second backboard which is parallel to the first, in order to form a succession of loops by folding. These loops are subsequently fixed to a support which is preferably coated beforehand with a glue, such as a polyvinylchloride paste, and onto which the loops will be deposited, the assembly thus formed by the support and the fixed loops being subsequently subjected to thermal treatment, for example passage through an infrared furnace.

According to another embodiment, the loops may be held between two supports, before a hot-melt adhesive passes through the said supports in order to impregnate the bases of the loops.

At all events, whether by fixing of the PVC type or of the hot-melt type, the product obtained either has a looped appearance resembling a looped tufted product or is of the "sandwich" type, consisting of loops trapped between two supports which may be subsequently split longitudinally in order to obtain two products of the pile fabric type.

Another alternative involves proposing the use of tensioned cables to replace the blades mentioned above.

According to the second large family of methods, successive folds are formed by means of a rotary system, by pushing the threads and/or fibres of the lap successively into protuberances present on a grooved cylinder. The folds are made under the action of a folding member, such as a blade or a roller, which are themselves grooved. Subsequently, a support, preferably coated beforehand with glue, is arranged on the succession of loops obtained by folding. If appropriate, the assembly consisting of the support and of the fixed loops is subjected to thermal treatment before these are removed from the grooved cylinder.

It is expedient to note that all these methods have the following disadvantages:

- their production speed remains relatively low. As an example, 120 strokes per minutes is already a relatively high speed for a system with arms, as described above, because of the complexity of the movement generated by the cam members;
- the quantity of adhesive necessary for fixing the loops to the support remains large, and therefore the products obtained are still relatively too costly;
- the range of products of the "lapped/bonded" type which can be produced is relatively limited.

On the other hand, the Applicant developed a technique for producing textile products directly from fibres and/or filaments, which is called the "verticalization technique".

This technique is described in the patent application published under number WO91/00382, and makes it possible to produce products, such as floor and/or wall coverings of the moquette type, directly from fibres and/or filaments travelling in the form of a web.

The technique described involves subjecting the fibres and/or filaments to "transverse looping" accompanied by "drawing" and obtaining an accumulation of fibres and/or filaments in the form of a crimped "pseudo-yarn", in which the fibres and/or filaments are parallelized. This step is referred to, in general terms, as the "(pre) looping step" and must not be likened to folding.

This document describes that transverse looping accompanied by drawing is carried out, for each individual fibre or filament, by means of rotary elements or looping discs which are spaced and arranged on a shaft transverse to the direction of advance of the web and between which looping fingers are arranged. Each fibre or filament is, in principle, thereby involved in at least one looping. A non-twisted pseudo-yarn is thus formed, obtained by the accumulation of the various exactly parallelized elementary fibres and/or filaments, the said accumulation having a looped form.

The accumulation of the parallelized fibres and/or filaments in the form of the pseudo-yarn takes place either in the open needle eye, as described in detail in the Applicant's publication WO91/00382, or in notches provided in transfer elements, as described in the document WO96/10667, also of the Applicant.

With the aid of these transport members consisting either of the needles or of the transfer elements, the pseudo-yarn is subsequently transported, in the form of transverse rows of loops, towards a support to which the loops are fixed.

In the publication WO91/00382, fixing is carried out by passing the needles through this support for the purpose of producing, more specifically, a floor covering of the tufted type.

This method was made even better by proposing the improvements described in European Patent Application EP 95870093.2, in which the method described in the publication WO91/00382 is combined with the use of a lap drawframe, as described in the document EP-A 0,520,911. Moreover, it is proposed to double the looping elements by adding a step called the "crimping step", so as to limit the forces on the shafts which arise as a result of the use of a web coming from a conventional lapper.

In this case, there are at least two separate assemblies of elements: the first assembly is intended for carrying out a crimping step by means of an apparatus consisting of the interpenetration of a first set of crimping discs with a first set of crimping fingers, whilst the second assembly is intended for carrying out the conventional subsequent step, called the prelooping step, by means of an apparatus consisting of the interpenetration of a second set of discs, called looping discs, with a second set of fingers, called looping fingers, this second assembly being arranged downstream of the crimping device in relation to the direction of advance of the web. The gauge of the crimping apparatus is a multiple of the gauge of the prelooping apparatus.

The products proposed in this document are essentially in the form of tufted products.

At this stage, it has been possible for this verticalization technique actually to achieve industrial use. In fact, it has been possible to control the levels of forces and torques even in the case of very large working widths (for example, greater than 4 meters).

Nevertheless, although this method can be fully put into practice on an industrial scale, it must be accepted that its productivity still remains limited. This is essentially due to the presence of transport members which execute an alternating movement and which are either in the form of needles or else in the form of transfer elements, as described in the document WO96/10667.

In fact, the production speed, which may be expressed as the product of the advance of the substrate per stroke (in mm) and the beating speed of the needles (in strokes per minute) reaches an order of magnitude of 1.5 to 4.5 m/min, this being perfectly acceptable for producing tufted products, but still remaining too low for production comparable to a needling line, the production speed of which may reach an order of 15 m/min.

Moreover, for obvious reasons of overall size due to the presence of needles or even of transfer elements between the looping discs, it is difficult for the gauge of a so-called verticalization apparatus to be below 1/10th of an inch, that is to say 2.54 mm, unless it becomes possible to produce highly accurate and therefore relatively costly members, thus depriving the so-called verticalization method of the possibility of producing products inexpensively.

On the other hand, a trend in the tastes of consumers towards fine-gauge products may be seen. These products are those where the advance per stroke and consequently productivity, too, are the lowest. This is a measure of the usefulness of a method in which very fine gauges would be easy to produce, without the production speed having to be limited.

OBJECTS OF THE INVENTION

The present invention aims to provide a solution to the existing limitations, more particularly as regards productivity, in the methods employed in the so-called verticalization technique, as is described in the documents WO91/00382 and WO96/10667.

The present invention aims, more particularly, to make it possible to produce so-called "lapped/bonded" products which may have an appearance close to those known in the prior art, whilst allowing very high productivity when the method is implemented.

The present invention aims, in addition, to make it possible to produce products of the "lapped/bonded" type having a fine gauge, that is to say a gauge below 1/10th of an inch.

Moreover, the present invention aims to make it possible to produce new products which have been impossible to produce at the present time, using the technique described as such in the Applicant's prior publications and, more particularly, in the publications WO91/00382 and WO96/10667.

MAIN CHARACTERISTIC ELEMENTS OF THE INVENTION

The present invention relates to a method for producing a textile product of the "lapped/bonded" type from fibres and/or filaments travelling in the direction of advance in the form of a web, this method comprising at least one-step, called the prelooping step, in which the fibres and/or filaments individually undergo looping transversely to the direction of advance, if appropriate accompanied by transverse drawing.

As already mentioned above, transverse looping accompanied by drawing is carried out, for each individual fibre or filament, by means of rotary elements or looping discs which are spaced and arranged on a shaft transverse to the direction of advance of the web and between which looping fingers are arranged. This makes it possible to ensure that each fibre or filament is involved in at least one prelooping step and allows the parallelization of these elementary fibres and/or filaments.

The present method is characterized in that confinement of the material in the form of loops consisting of the particularly exactly parallelized fibres and/or filaments is carried out, and in that this confinement takes place directly on a support, without transport members, such as needles or transfer elements, being involved.

This confinement is obtained after a first transient step which is associated with the start-up of a product line and during which the first loops obtained by means of the step of prelooping the individual fibres and/or filaments form a stop in an arbitrary manner. The confinement takes the form of an accumulation of loops, which consist of parallelized fibres and/or filaments, one behind the other.

The successive loops are positioned essentially vertically by means of a detaching element which makes it possible to guide the material as far as the support, whilst at the same time holding the said material by means of a bar assembly.

The support may be directly the final substrate of the product to be produced and therefore consist of a fibre mat, a plastic film, a backing of the PVC type, etc.

If appropriate, instead of being deposited directly onto the substrate of the final product, the confined material could be gripped by an intermediate element, such as a spiked belt, a brush or a Velcro® support, the function of which is to maintain the crimped form of the loops while the free end of the material is being fixed to a substrate.

This fixing to the substrate is carried out by means of a glue, the viscosity of which is designed to make it possible to drive the individual fibres and/or filaments of the material, together with the substrate, whilst at the same time carrying out efficient adhesive bonding.

In general terms, it is possible to use either pastes or resins (acrylic, isocyanate, styrene-butadiene, phenolic, etc.) or thermoplastics in the form of a hot melt, film or powder (polyesters, polypropylene, EVA, PVC, etc.) or foams (PVC, acrylic, etc.), or direct adhesion by melting the verticalized fibre onto the substrate may be carried out. The means used for supplying the heat necessary for this purpose are preferably provided by an infrared furnace, a calender or a heating drum or else heating blades which take the form of plane metal parts comprising electrical resistors or ducts for the passage of heat-exchange fluids.

The speed of advance of the substrate may either be uniform or take place in bursts, in such a way that more marked confinement of the textile material on this support is obtained.

BRIEF DESCRIPTION OF THE FIGURES

The present invention will be described in more detail by means of the following figures.

DESCRIPTION OF SEVERAL PREFERRED EMBODIMENTS OF THE INVENTION

Figure 1:
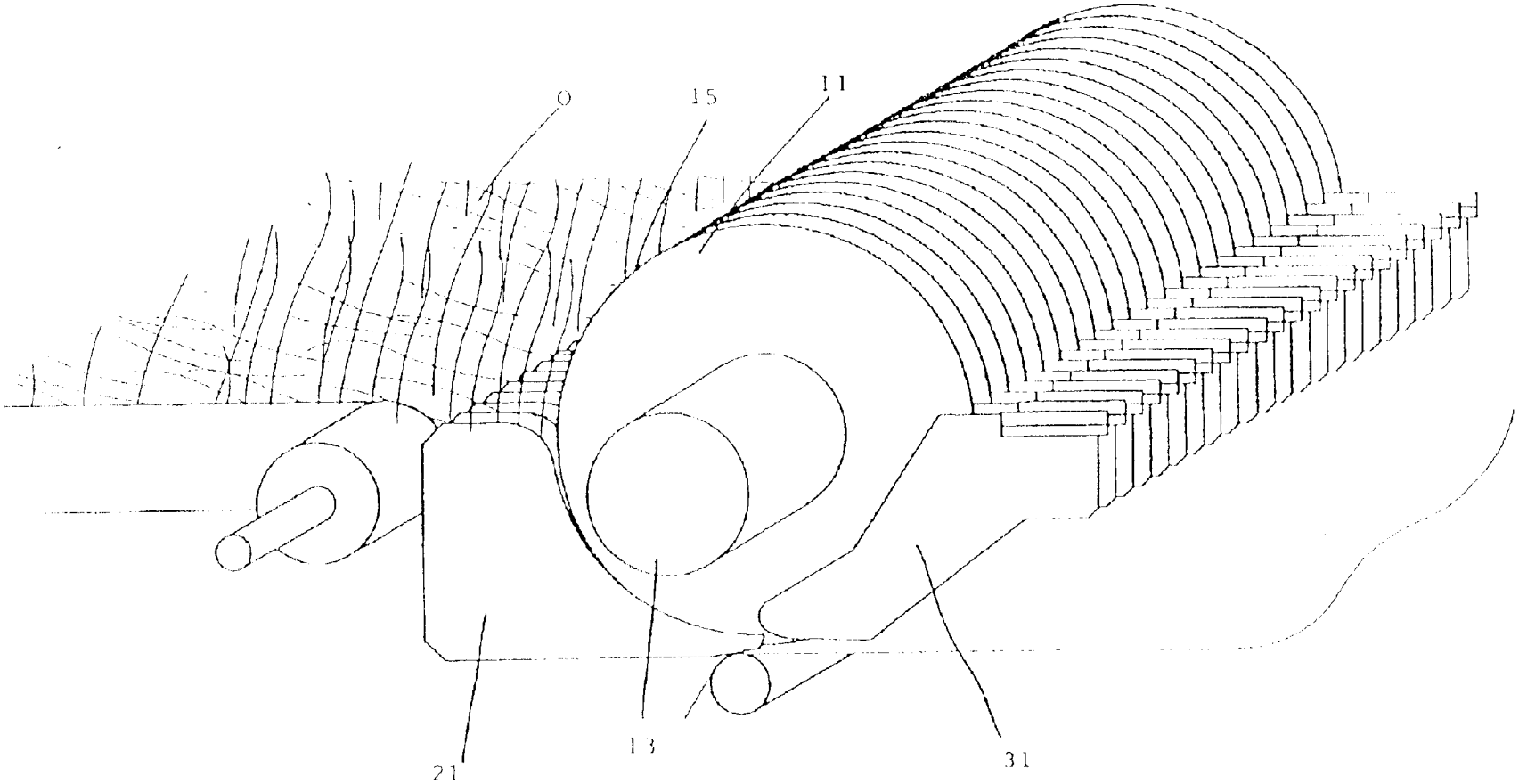
FIG. 1 describes diagrammatically the verticalization apparatus, as used in the present method.

In the conventional way, a web of fibres and/or of filaments having conditions as to the position of the fibres and/or filaments within the web and as to weight, as are described in the Applicant's prior publications, is delivered into the region of the verticalization apparatus described in FIG. 1.

This apparatus comprises essentially a set of discs, called "looping discs", bearing the reference 11 and carried on a common transverse shaft 13 driven in continuous rotation at a peripheral speed preferably equal to the entry speed of the web 0. The looping discs 11 are provided, on their periphery, with a toothing 15 which has a suitable angle relative to the tangent and which makes it possible to drive the entry web. Arranged between each of the discs are looping fingers 21, the end of which is presented essentially tangentially relative to the discs. This apparatus makes it possible to carry out the step called the "prelooping step", which involves subjecting the fibres and/or filaments individually to transverse looping accompanied by drawing, for the purpose of parallelizing them correctly.

In order to understand better the method on which the present invention is based, it is expedient to refer to the various FIGS. 2*a* to 2*e* which describe the successive steps of preparing the textile material intended for the production of the specific products of the lapped/bonded type.

Figure 2A:
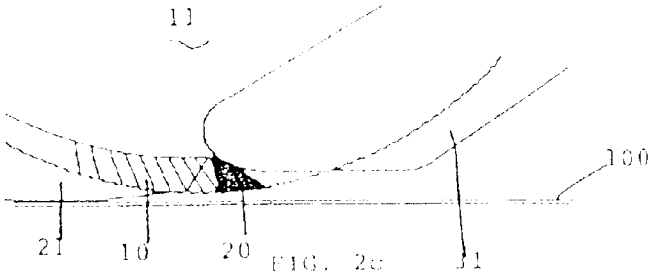
FIGS. 2*a*–2*e* describe the successive steps of preparing the textile material, of verticalizing the fibres and/or filaments forming this material, of parallelizing them and of confining them.

More particularly, FIG. 2*a* describes the step, in which the web 0, consisting of the individual fibres and/or filaments 10, has just been introduced between the looping discs 11 and the looping fingers 21. The fibres and/or filaments 10 individually undergo the prelooping step already described, which corresponds to individual transverse looping, if appropriate accompanied by drawing. The parallelized fibres and/or filaments 10 are subsequently delivered towards the end of the looping fingers 21.

According to the method of the present invention, due to the absence of transport members, such as needles or transfer elements, which experience an alternating movement, there is no limit to the dimensioning, and therefore the forces absorbed may be markedly greater. This also means that the forces experienced by the shaft may be greater, thus allowing more latitude in the orientation of the fibres and/or filaments at the web entry.

Figure 2B:
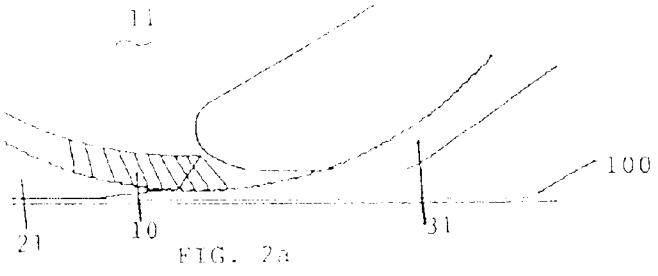

FIG. 2*b* shows that the fibres and/or filaments 10, which continue to be driven by the rotating looping discs 11, are subsequently blocked due to the presence of detaching feet 31, against which they begin to accumulate one behind the other so as to form a stop (or "plug") 20. In this case, the fibres and/or filaments are sharply inclined and may even, in a borderline case, be virtually horizontal.

Figure 2C:
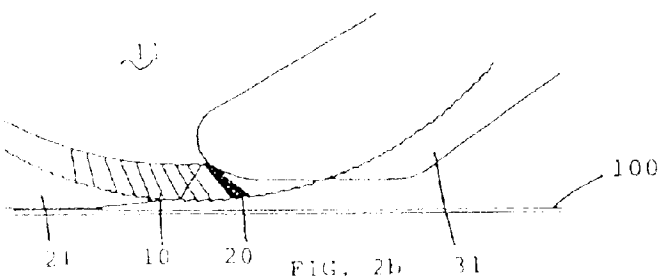

FIG. 2*c* shows that this stop or "plug" 20 tends to expand downwards in the direction of a substrate 100.

Figure 2D:
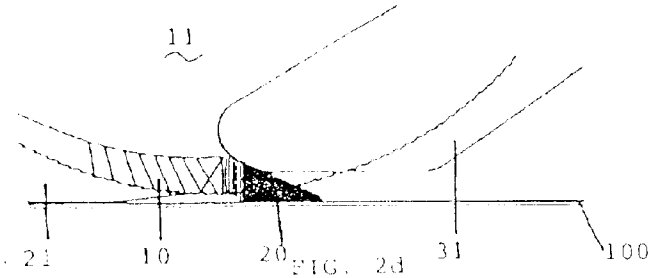

FIG. 2*d* shows that the "plug" 20, consisting of the accumulation of parallelized and crimped fibres and/or filaments, ultimately attains a volume such that it comes into contact naturally with the substrate 100 arranged just below the looping fingers 21. In this case, the fibres and/or filaments coming directly from the prelooping step are condensed during a step called the "confining step", this time vertically, against the obstacle formed by the "plug".

Figure 2E:
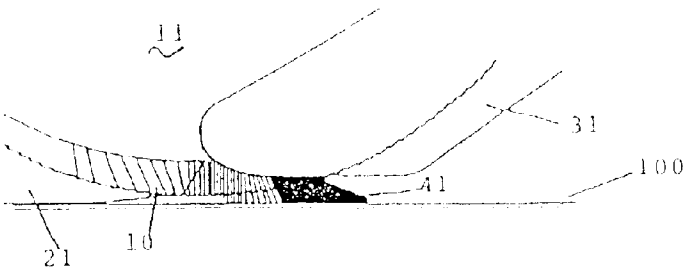

FIG. 2*e* shows that the "plug" 20 is driven by the substrate 100, being assisted in this by the rotation of the looping discs 11 and by the pressure exerted by the parallelized fibres and/or filaments 10 which continue to come from the looping fingers 21. This phase shows that the fibres and/or filaments are subsequently deposited uniformly onto the substrate 100, without any more accumulation in the form of a "plug". In this case, these fibres and/or filaments are arranged essentially vertically.

According to a particularly preferred embodiment, there is provision for the detaching feet 31 to have a particular form in order to make this step easier. The detaching feet are arranged so as to be capable of forming a funnel 41 between the said feet and the substrate 100 which continues to flow.

In this last step, the detaching feet 31 no longer have the function of detaching the fibres and/or filaments from the looping fingers, but, instead, the function of promoting the fixing of the said fibres and/or filaments to the substrate. Moreover, the rounded part of the detaching feet will make it possible to guide the confined fibres and/or filaments towards the substrate, whilst its oblique part, located at a distance from the substrate which is slightly shorter than the looping height, will exert pressure on the parallelized fibres and/or filaments in order to compel them to adhere to the support.

The tension present within the fibres and/or filaments at the moment when they are confined on the detaching feet is lower than that prevailing within the material undergoing the prelooping step, thus making it possible for the parallelized fibres and/or filaments to be easily driven together with the substrate. In fact, if the tension experienced by the fibres and/or filaments at the end of the looping fingers during the prelooping step were lower than the reaction pressure exerted by the "plug" or stop in the funnel formed by the detaching feet 31 and the substrate 100, the fibres and/or filaments 10 would then begin to accumulate between the looping discs 11 and looping fingers 21, this occurring as far as the web entry. There would therefore be no automatic drive of the material together with the substrate.

This tension depends essentially on the orientation of the fibres and/or filaments in the web at the entrance of the verticalization apparatus.

The presence of this tension within the fibres and/or filaments allows the assembly as a whole to function as a "non-return valve" by preventing the fibres and/or filaments from accumulating on the looping fingers.

It is expedient to note that although, as described in the Applicant's preceding publications, a yarn or pseudo-yarn is not actually made, the fibres and/or filaments obtained are nevertheless perfectly parallelized. Moreover, the density of the loops can be adjusted by varying the ratio of the speed of advance of the substrate to the disc drive speed.

In order to produce products of the lapped/bonded type, it is preferable if the substrate 100 is coated beforehand with a glue, the viscosity of which will have been selected so as to allow the fibres and/or filaments 10 to be driven, together with the substrate, whilst at the same time carrying out efficient adhesive bonding.

If appropriate, it is conceivable to provide means for activating the glue in order to cause it to react at the moment when the fibres and/or filaments are deposited onto the substrate. Examples of glues, such as paste, acrylics or such like glues, may, of course, be considered. Apparatuses and methods of activation may be selected from apparatuses or methods acting by contact, such as calenders, heating blades, etc., apparatuses or methods working by hot air, such as furnaces, pulsed-air apparatuses, etc., or, if appropriate, apparatuses or is methods working by radiant, infrared or such like energy.

Figure 3:
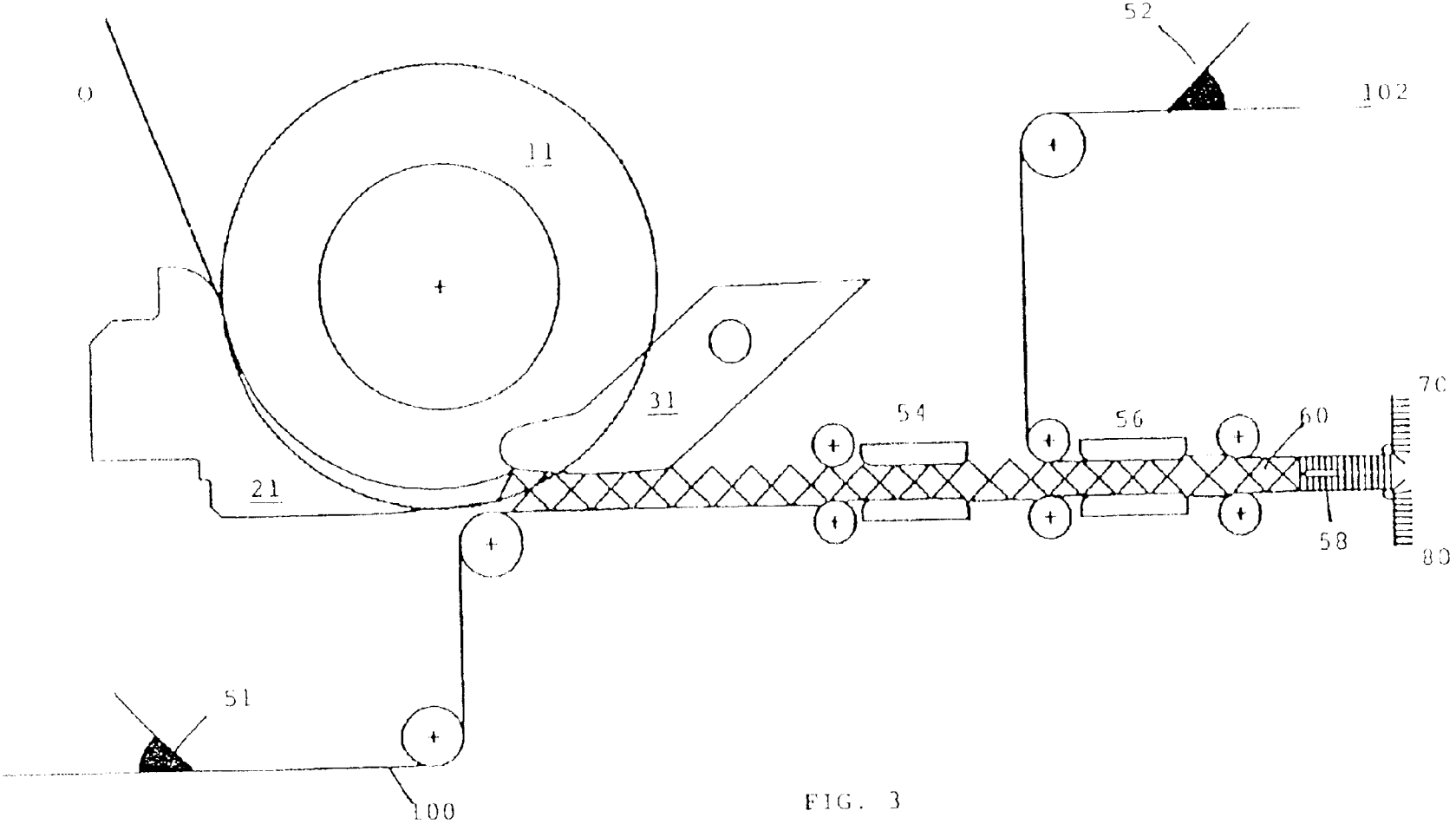
FIG. 3 describes an apparatus which makes it possible to produce a textile product in the form of a lapped/bonded product of sandwich type in a first embodiment of the method according to the present invention.

FIG. 3 illustrates a preferred embodiment for implementing the method according to the present invention for the purpose of producing lapped/bonded products of the sandwich type.

This figure illustrates a looping disc 11, on which is superposed a looping finger 21, in the extension of which a detaching foot 31 is arranged. A web 0 of suitably oriented fibres is driven by a succession of looping discs 11.

The method for prelooping and confining the material directly on a support which advances is carried out in the way described in FIGS. 2*a* to 2*e*.

According to the embodiment illustrated in FIG. 3, paste is deposited with the aid of a wiper 51, for the purpose of fixing the loops, consisting of fibres and/or filaments which have come from the prelooping step and the confining step, to the substrate 100. The product obtained is subsequently subjected to thermal treatment by means of heating plates 54, in order to obtain gelling of the paste. A second substrate 102, likewise coated with a paste deposited with the aid of a wiper 52, is subsequently deposited onto the product consisting of the first substrate 100 and of the fixed loops, in order to make a sandwich product 60. This sandwich product 60 is subjected once more to thermal treatment by means of heating plates 56, in order to obtain the gelling of the paste present on the second substrate 102. Finally, a blade 58 separates the sandwich product 60 into two by splitting it in order to obtain two products of the pile fabric type 70 and 80.

The present invention makes it possible to produce a series of products which it was not possible to obtain, using the methods and/or apparatuses, such as those described in the Applicant's prior applications.

Three large families of textile products can be produced by means of the method according to the present invention.

A first large family comprises coverings for floors, walls or motor vehicles. In particular, it is conceivable to produce a product akin to looped tufted or pile fabric, for which the most common gauges are 5/64" to 5/32". In this case, the glues used will be mainly pastes, PVC or acrylics, whilst the substrates may be woven fabrics, non-wovens or else glass mats (in the specific case of tiles).

It is also conceivable to produce low-density uniform-appearance pile fabric products of the vertical needled type, for which the gauges will range from 1/16" to 5/64".

Finally, low-height, but high-density pile fabric products of the flocked type may also be produced for gauges of below 1/16". In this case, the glues used are preferably thermoplastics.

Advantageously, it can be seen that the apparatus used for carrying out the method according to the present invention does not comprise any sensitive member, such as needles or transfer elements which execute alternating movements. It is therefore even possible to use coarse natural fibres.

These various products have intrinsic economic usefulness and interesting functional aspects, such as low sensitivity to moisture, easy maintenance, etc.

The second large family embraces furnishing fabrics, such as seat covers, wallpapers, etc. In this case, the gauges will be particularly low, of the order of 1/32", and the fibres used will preferably be very fine. It is even conceivable to employ microfibres.

Particularly in order to obtain a suede appearance, a glue is used which has the property of expanding until it completely fills the space between the two substrates of a product of the sandwich type, such as a glue of the PVC, acrylic or polyurethane foam type, in order to trap the fibres. The suede appearance is simply obtained by splitting and then sueding.

The third large family relates to industrial textiles which are structured in sandwich form and which are therefore not split.

Of these textiles, mention may be made of geotextiles which may be used as a draining structure or as a structure with powders of the bentonite type being included. Mention may also be made of panel structures, the rigidity of which is provided by the sandwich form and in which the space between the two substrates is filled with a resin or a foam.

In order to illustrate this last family of products more clearly, reference will be made to FIG. 4 which describes the way of producing more specifically a composite geotextile product, with clay powder of the bentonite type being included.

Figure 4:
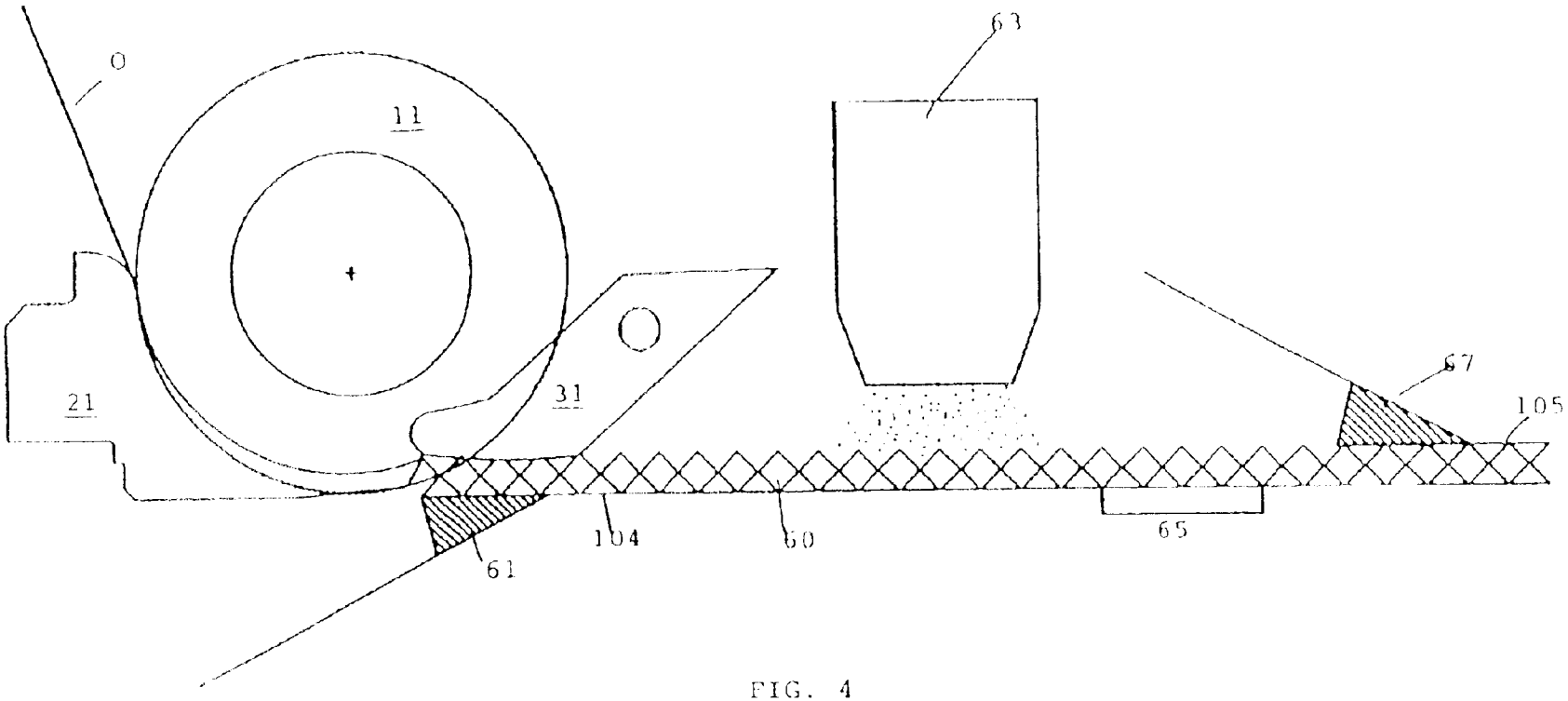
FIG. 4 describes an apparatus which makes it possible to produce a textile product containing bentonite powder in another embodiment of the method according to the present invention.

According to a preferred embodiment illustrated in FIG. 4, according to the present invention a prelooping step is carried out by means of looping discs 11, between which looping fingers 21 are present and in the extension of which detaching feet 31 are provided. Introduced into this apparatus is a web consisting, in the present case, of fibres of high linear density, for example higher than 80 dtex, if appropriate mixed with finer fibres having, for example, a linear density of 17 dtex, the purpose of which is to make it easier to card the web. The web 0 is driven between the succession of looping discs 11 and fingers 21 in order to carry out the prelooping and confining steps, as described in more detail in FIG. 2.

A substrate 104 is delivered as far as the point where the fibres are detached by being pressed onto a heating blade 61. The substrate preferably consists of fibres having a melting point higher than the melting point of the fibres present in the loops which have come from the prelooping and confining steps. This heating blade 61 makes it possible to reach a temperature which is higher than the melting temperature of the loops which adhere directly to the substrate 104 by contact in order to obtain a product 60.

Bentonite powder is subsequently deposited with the aid of a conventional means 63 onto the product 60 which consists of the substrate fixed to the loops.

The assembly as a whole subsequently passes onto a vibrating table 65 for the purpose of promoting the migration of the bentonite powder within the product 60 so as to obtain as uniform a distribution as possible. This is possible, in particular, due to the high linear density of the fibres present in the loops and to their great resilience, this preventing them from being crushed under the pressure of the powder. Moreover, the height of the loops is selected as a function of the weight of the powder to be deposited, in order to obtain a space free of powder on the upper part of the product, in such a way that a second substrate 105 can be deposited onto it by means of a second heating blade 67.

This results in a sandwich structure, in which the bentonite powder is retained uniformly.

These products are generally used together with geodiaphragms in order to ensure leaktightness. In fact, if a liquid is present, the bentonite swells, at the same time absorbing the latter and thereby ensuring self-sealing of the breach.

What is claimed is:

1. An apparatus for producing a textile product from a web of fibers and a substrate of, said apparatus comprising:

a rotatable shaft mounted transversely to the process direction of the web;

a plurality of looping discs mounted to the shaft for rotation therewith, each of said looping discs having a periphery provided with teeth;

a plurality of looping fingers arranged between and substantially parallel to said looping discs;

means for advancing the substrate advancing in a process direction; and a plurality of stationary detaching elements that define a space between each detaching element and the substrate, wherein said looping discs and looping fingers interact to loop the fibers to form prelooped fibers, said teeth engage the prelooped fibers to advance them in the process direction where the prelooped fibers accumulate against the stationary detaching elements to form a prelooped web and said detaching elements act on said accumulated prelooped web to secure the said prelooped web to the substrate without the aid of reciprocating transport members.

2. The apparatus of claim 1, wherein said detaching elements comprise a forward portion nearest the looping discs and looping fingers, said forward portion having a rounded configuration which guides the prelooped web toward a support which corresponds to the substrate itself.

3. The apparatus of claim 1, wherein the space defined between the detaching elements and the substrate has a height measured between a bottom edge of the detaching element and the substrate, said height decreasing in the process direction and the advancing prelooped web encounters said bottom edge and accumulates in said space to form a plug which is directed against said substrate by said bottom edge.

4. The apparatus of claim 1, wherein said substrate comprises a substrate of the textile product.

5. The apparatus of claim 1, wherein a support corresponding to an intermediate element grips the prelooped web to maintain the crimped form of the loops, while a free end of said prelooped web is being fixed to the substrate.

6. The apparatus of claim 5, wherein said intermediate element includes means for gripping said prelooped web selected from the group consisting of adhesive, spikes, hooks, or brushes.

7. The apparatus of claim 1, comprising means for coating said substrate with an adhesive having a viscosity selected to promote efficient bonding between the prelooped web and the substrate.

8. The apparatus of claim 1, comprising means for applying heat which produces adhesion between the prelooped web and the substrate by melting.

9. The apparatus of claim 8, wherein said means for applying heat are selected from the group consisting of a furnace, a calendar, a drum or a heating blade.

10. The apparatus of claim 1, comprising means for varying the rate of advance of said substrate in the process direction to vary the density of deposit of the prelooped web onto said substrate.

11. The apparatus of claim 1, comprising means for applying a second substrate onto the prelooped web to produce a sandwich product.

12. The apparatus of claim 11, comprising means for cutting the prelooped web between said substrates to obtain two pile textile products, each of said pile textile products comprising one said substrate covered by a layer of cut prelooped web.

13. The apparatus of claim 11, comprising means for introducing a powdery material into said prelooped web prior to applying the second substrate.

14. The apparatus of claim 11, comprising means for introducing solid elements into said prelooped web prior to applying the second substrate.

* * * * *